US011547899B2

(12) United States Patent
Williams

(10) Patent No.: US 11,547,899 B2
(45) Date of Patent: Jan. 10, 2023

(54) PROCUMBENT EXERCISE APPARATUS

(71) Applicant: Marty Williams, Colorado Springs, CO (US)

(72) Inventor: Marty Williams, Colorado Springs, CO (US)

( * ) Notice: Subject to any disclaimer, the term of this patent is extended or adjusted under 35 U.S.C. 154(b) by 0 days.

(21) Appl. No.: 16/833,489

(22) Filed: Mar. 27, 2020

(65) Prior Publication Data

US 2021/0299513 A1 Sep. 30, 2021

(51) Int. Cl.

*A63B 22/06* (2006.01)
*A63B 21/00* (2006.01)
*A63B 21/22* (2006.01)

(52) U.S. Cl.

CPC ..... *A63B 22/0605* (2013.01); *A63B 21/151* (2013.01); *A63B 21/22* (2013.01); *A63B 21/4034* (2015.10); *A63B 21/4035* (2015.10); *A63B 21/4039* (2015.10); *A63B 2022/0611* (2013.01); *A63B 2022/0647* (2013.01); *A63B 2225/09* (2013.01)

(58) Field of Classification Search

CPC ..... A63B 22/0605; A63B 21/4034; A63B 21/151; A63B 21/22; A63B 21/4035; A63B 21/4039; A63B 2225/09; A63B 2022/0611; A63B 2022/0647; B62K 19/40; B62K 3/00; B62K 3/005

See application file for complete search history.

(56) References Cited

U.S. PATENT DOCUMENTS 326,247 A * 9/1885 Root ..... A63B 21/00178 601/36
575,787 A * 1/1897 Voitek ..... A61G 5/10 297/487
3,759,511 A * 9/1973 Zin ..... A63B 21/015 482/142
4,285,515 A * 8/1981 Gezari ..... A63B 22/0605 600/587
4,647,060 A * 3/1987 Tomkinson ..... B62K 3/005 280/288.1
5,941,804 A * 8/1999 Johnston ..... A63B 23/0429 482/142
6,050,584 A * 4/2000 Sibson ..... B62M 9/04 280/288.4
7,311,362 B2 * 12/2007 Gaffney ..... A47C 9/005 280/288.4
7,442,153 B1 * 10/2008 Chasnov ..... A63B 21/4011 482/142
10,384,111 B2 * 8/2019 Liao ..... A63B 21/0055
10,974,118 B2 * 4/2021 Bass ..... A63B 69/16
2006/0003870 A1 * 1/2006 Corbalis ..... A63B 22/0605 482/57
2006/0234836 A1 * 10/2006 Kuo ..... A63B 22/0605 482/57
2009/0170667 A1 * 7/2009 Irving ..... A63B 21/225 482/57

(Continued)

*Primary Examiner* — Andrew S Lo
*Assistant Examiner* — Andrew M Kobylarz
(74) *Attorney, Agent, or Firm* — Apex Juris, pllc; Tracy M Heims

(57) ABSTRACT

An exercise apparatus having a stationary frame, a handlebar assembly, a frontal-torso assembly, a resistance assembly, a rotatable crankset having a pair of crankarms with pedals mounted thereon where the crankset is positioned rearward of the handlebar assembly and the frontal-torso assembly.

16 Claims, 10 Drawing Sheets

(56) References Cited

U.S. PATENT DOCUMENTS

| | | | | |
|---|---|---|---|---|
| 2010/0289246 | A1* | 11/2010 | Williams | B62K 3/02<br>280/281.1 |
| 2017/0072254 | A1* | 3/2017 | Ryu | A63B 69/16 |
| 2019/0168062 | A1* | 6/2019 | Monti | A63B 21/4033 |

* cited by examiner

PROCUMBENT EXERCISE APPARATUS

FIELD OF THE INVENTION

This invention relates to indoor exercise devices and more particularly to the field of exercise devices designed for a procumbent or weight forward body position.

BACKGROUND OF THE INVENTION

The design of bicycles and related outdoor and indoor exercise bikes has evolved little since their initial popularity dating back to the $19^{th}$ century. The standard bicycle along with the indoor exercise apparatus or bicycle design typically includes a frame having a bicycle seat that is interfaced by a rider's pubic area and the seat is generally mounted above and slightly behind a bottom bracket that supports a crank set onto which drive pedals are mounted. While new technology has evolved in frame materials, frame design, shifting and brake design, little has changed in the overall engagement of the human body in relation to the saddle style and body position used on conventional bicycles, exercise bicycles and exercise apparatus.

Most bicycles and other pedaling exercise apparatus require the rider to sit upright or crouched over on the upright seat. This riding position creates significant wind drag when used outside as a bicycle and it creates an uncomfortable position while riding, both outside and inside on training devices. While racers and other performance riders may crouch to lower that drag, the overall position still creates aerodynamic problems as well as discomfort.

An additional problem with this position is that most of the power to drive the bicycle is created by the rider's legs, with little or no upper body contribution. In other words, during exercise the rider works out the legs and gets a minimal cardio workout, but the rest of the body is not utilized. During general usage, the rider places his gluteus maximus on the seat and solely powers the bicycle or resistance exercise bike or exercise apparatus using the legs. The trunk and upper body of the rider is little used in these bicycles and apparatuses.

Another problem with the current design of bicycles and exercise bike designs occurs from the position of the rider. Many riders suffer from sitting upright or in a crouch on the bicycle. Discomfort from this position can arise as well, causing lower back pain and even numbness in the groin region. This discomfort arises from having the rider's weight centered on the saddle in an upright seated position. Saddles are typically narrow to minimize weight and to increase aerodynamics, and are by nature uncomfortable. This same seat design is also utilized in stationary bicycles.

Riders often crouch over the handlebars to shift weight off their groin area. This position is also uncomfortable and causes fatigue. Serious medical issues may arise from this position as well as the upright position, commonly known as bike seat neuropathy.

Recumbent bicycles were developed in response to these issues and allow the rider to sit in a reclining position to alleviate the sitting issues and to provide just a more comfortable ride overall. However, again the power stroke of the rider is limited to use of the legs of the rider only and the rider has a very limited range of movement. Again, there are issues with the sitted position as your gluteus muscles suffer here as well. Similar problems exist in the design of many exercise devices. Most stationary bicycles require the rider to sit in an upright position. This leads to numbing in the lower back and groin of the rider. This is further exacerbated by the lack of movement of the rider since the equipment is stationary. Also, only the lower body undergoes exercise.

Thus, problems exist in the design of present bicycles and in those related bicycle-like designs used in exercise equipment. The present bicycles and bicycle-like exercise apparatus do not provide an efficient design to allow the rider to utilize more of the body in transferring power from the body to the resistance bicycle or bicycle-like apparatus nor do they provide a comfortable design.

It should be appreciated that all combinations of the concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

SUMMARY OF THE INVENTION

The present invention solves these and other problems by providing a design for supporting the rider and for modifying the power transfer. Embodiments of the present invention support the rider in a profile to improve the ergonomic characteristics of the rider. The power transfer of the rider is also greatly improved to allow the rider to increase the power stroke and use more of the full body during exercise. This application sets out and explains a bicycle embodiment, both for adults and children, and an exercise apparatus. However, it should be understood that numerous other embodiments could also be utilized including that for motorized devices, such as motorcycles or electric bicycles or any other device or apparatus that features the design of the present invention.

The embodiments of the present invention utilize a unique saddle assembly that enables the rider to be supported in a forwardly extending position. This allows for a better weight transfer of the rider to the upper body and torso, while eliminating contact with the rider's groin and/or pubic area. The unique saddle assembly of this first embodiment of the present invention used in combination with a bicycle drive assembly that is behind the seat provides a more efficient power transfer. The swing sling assembly supports the anterior pelvic region of the rider and this saddle assembly is positioned in front of the pedals and cranks so the rider extends forwardly or procumbently over the exercise apparatus. The rear mounted drive assembly allows a fuller extension of the rider's body to transmit power not only from the legs of the rider but from the upper body and trunk of the rider as well.

A first embodiment of the present invention is an exercise apparatus that utilizes the saddle assembly whereby the saddle supports the anterior pelvic region of the rider. The saddle assembly is configured out of pads, tensioned fabric or other support configurations that are adjustable to support the anterior pelvic region. The exercise apparatus also includes a rear mounted drive assembly that supports the feet of the rider. This allows the rider to fully extend forwardly over the exercise apparatus instead of forcing the rider to an upright position. This improves the exercise experience by forcing the rider to use more upper body muscles and not sit on their pubic or groin area.

The rear mounted drive assembly of the above described embodiment is positioned behind the swing sling. The crank includes pedals that are engaged by the rider's feet. The rider is thus able to power the crank through a full body extension rather than just the legs, as was the case of all prior bicycles. This procumbent position also allows the rider to exercise at a 100% effort level by supporting themselves by the arms and legs with or without the saddle in the procumbent position.

A second embodiment of the present invention is a bicycle that utilizes the swing sling assembly whereby the swing sling supports the anterior pelvic region of the rider. The sling swing assembly is configured out of pads, tensioned fabric or other support configurations that are adjustable to support the anterior pelvic region. The bicycle also includes a rear mounted drive assembly that supports the feet of the rider. This allows the rider to fully extend forwardly over the bicycle instead of forcing the rider to an upright position. This improves the exercise experience by forcing the rider to use more upper body muscles and not sit on their pubic or groin area.

The rear mounted drive assembly of the above described embodiment is positioned behind the saddle. The crank includes pedals that are engaged by the rider's feet. The rider is thus able to power the crank through a full body extension rather than just the legs, as was the case of all prior bicycles. This procumbent position also allows riders to exercise at a 100% effort level utilizing the arms and legs as support, with or without the saddle in the procumbent position.

The present invention may also be incorporated into other types of mechanisms where the rider is supported forwardly on their anterior pelvic region instead of their posterior, or gluteus maximus. These mechanisms may include but are not limited to scooters, kid's bicycles that could have pedals or have no pedals and would act as a strider bicycle, electric bicycles, motorcycles, and other devices.

These and other features of the present invention will be evident from the ensuing descriptions of embodiments and from the drawings.

DETAILED DESCRIPTION

Stationary Exercise Apparatus. A first embodiment of the present invention is illustrated in the Figures. It is to be expressly understood that the descriptive embodiment is provided herein for explanatory purposes only and is not meant to unduly limit the claimed invention. Other embodiments of the present invention are considered to be within the scope of the claimed invention, including not only those embodiments that would be within the scope of one skilled in the art, but also as encompassed in technology developed in the future.

Figure 1:
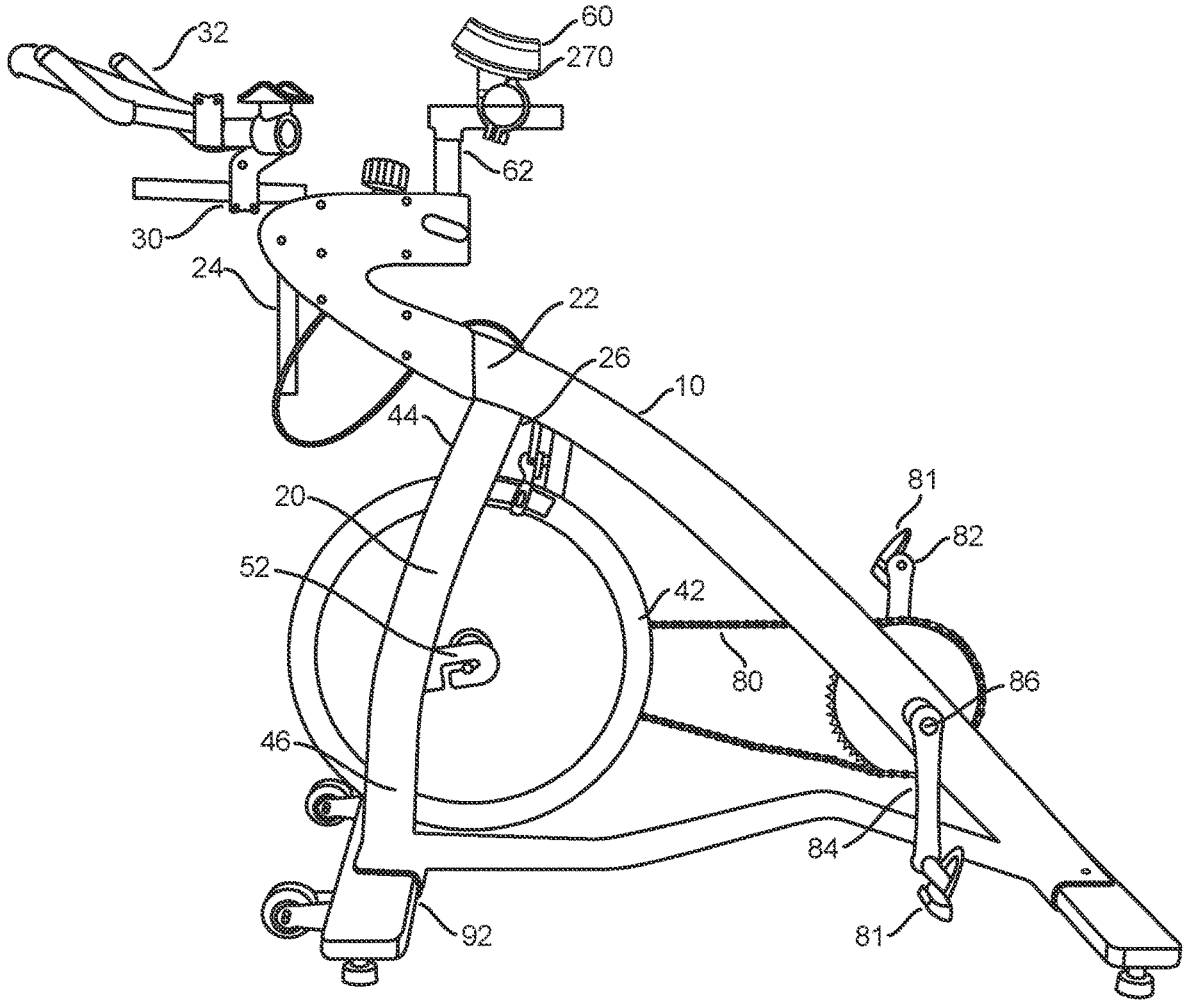
FIG. 1 is a side view of a preferred embodiment of the present invention.

The descriptive embodiment illustrated in FIG. 1 is a stationary exercise apparatus 10 for exercise use. It is to be expressly understood that other embodiments are covered under the present invention. Also, different components of this descriptive embodiment may have application in other usage as well. For example, different components may have applicability in exercise equipment and in other vehicles as well, such as motorcycles, scooters, kid's bicycles, electric bicycles, and motorized vehicles.

Embodiment one is a Stationary Exercise Apparatus. The stationary Exercise apparatus 10 illustrated in FIG. 1 includes a frame 20, a handlebar system 30, a resistance wheel 42, a saddle system, or frontal-torso assembly 60, a pair of mating adjustment plates 23, and a resistance assembly 80. The system further includes a crank 82 and pedals 81 that are secured to the crank 82 and whereby the crank 82 is secured to an axle 86 and powers the drive train 80. These components are integrated into a novel combination to create a more comfortable and more powerful presence of the rider's physiology and the exercise apparatus. Specifically, FIGS. 1 and 2 are an exercise apparatus 10 that is a stationary frame 20 having a handlebar assembly 30, a frontal-torso assembly 60, a pair of mating adjustment plates 23, a resistance assembly 42, a rotatable crankset 82 having a pair of crankarms 84 with pedals 81 mounted thereon wherein the crankset is positioned rearward of the handlebar assembly and the frontal-torso assembly.

The design is configured so that a rider first engages his feet with the pedals. Then, the rider leans forward, rests his iliac region on the frontal-torso assembly 60 and then places his hands on the handlebar system 30. In this unique design the drive train of the exercise apparatus is designed so that the rider engages the pedals behind the rider's torso while in a weight forward or procumbent body position. The rider is mounted on the exercise apparatus in a forward position rather than in the upright position of most bicycle-based exercise devices. This provides a substantially improved workout and comfort level while at the same time greatly decreases or eliminates groin and pubic pain typically experienced by the rider which in turn improves the overall exercise experience and workout performance of the rider. Not only is the numbing and pinching of the pubic area removed from the rider's experience, but the power stroke of the rider is increased as well. This unique combination of novel features of individual components adds unique improvements to the exercise experience.

This exercise apparatus further can have an adjustable frontal-torso assembly mounting apparatus to attach and adjust a position of the frontal-torso assembly 60 to the frame. This allows for the assembly to be adjusted for individual users in order to make the apparatus more comfortable. This frontal-torso assembly 60 can also have at least one pelvic support to support an anterior pelvic region of a rider. And, preferably, the at one pelvic support is at least two pelvic supports that are spaced apart from one another to provide individual support to each anterior pelvic regions of a rider. This provides much greater comfort to the rider. These pelvic rests 270 can be seen in FIG. 2 and can additionally include a flexible member to provide support to the anterior pelvic region of the rider. This could be pad such as a gel, or memory foam, or rubber, or any other material that will provide additional absorption and comfort to the rider. This frontal-torso suspension assembly further can include a gimbaled mechanism to adjust suspension and to allow for more rider motion. In one embodiment the frontal-torso assembly is held in place by the pair of mating adjustment plates 23, as shown in FIG. 1. In this embodiment there are two matching plates, one facing the other, that are designed to hold the frontal-torso assembly and the handlebar assembly between the two plates. These plates are configured so that the adjustable frontal-torso assembly is mounted between the two plates. In addition, the handlebar system 30 is also mounted between the mating adjustment plates 23. This configuration provides an apparatus to hold and secure both the handlebar system 30 and the frontal-torso assembly 60 simultaneously, as is shown in FIGS. 1 and 2. This adjustment plate system allows for the vertical adjustment, and possibly horizontal adjustment, of both the handlebar system 30 and the frontal torso assembly 60.

Figure 2:
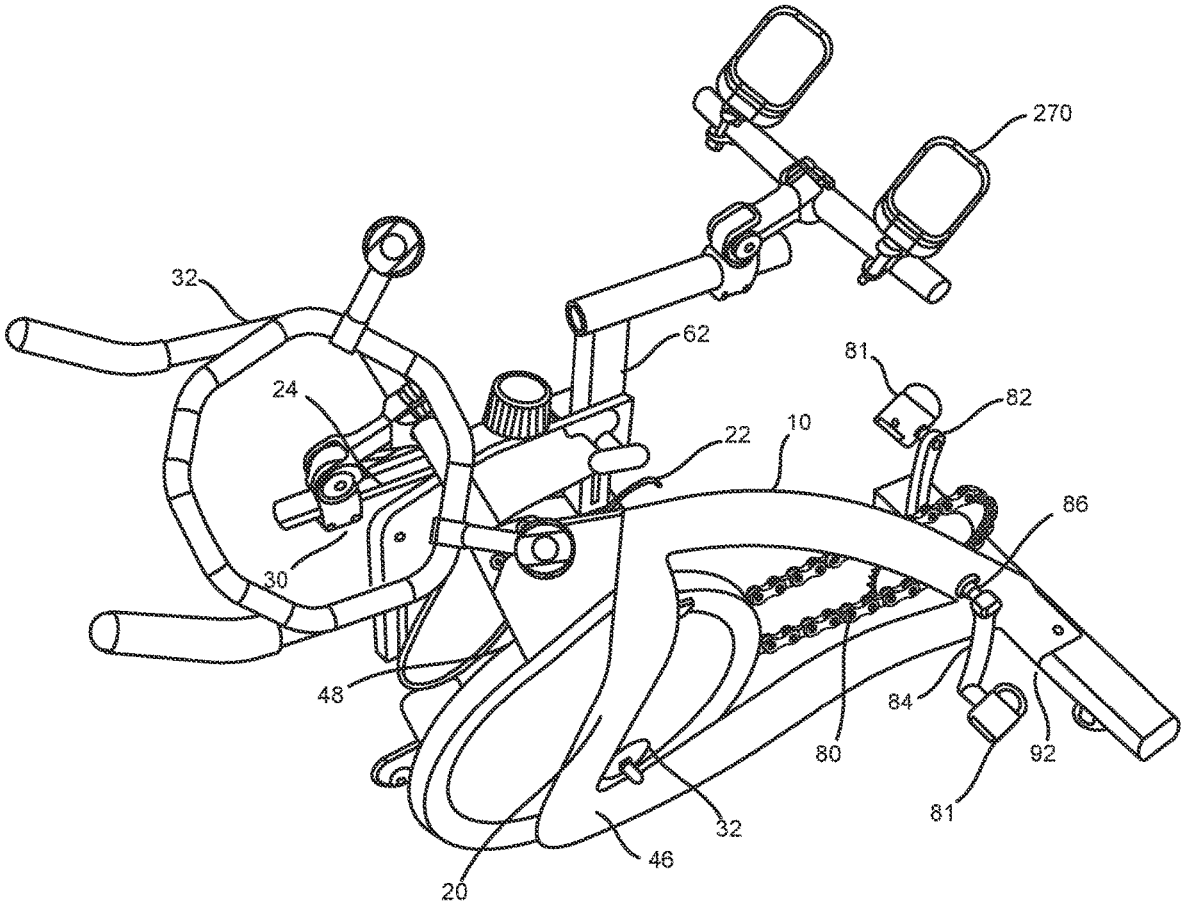
FIG. 2 is a perspective view of the present invention.

The embodiment shown in FIGS. 1 and 2 also has a resistance assembly. In one embodiment this resistance assembly is a wheel and a wheel tensioning apparatus. This wheel and said crankset are connected via a chain and the crankset and the tensioning mechanism operate together and internally.

A more detailed description of a bicycle utilizing this configuration will be set out below as a second embodiment.

The frame 20 of the exercise apparatus 10 of the first preferred embodiment of the present invention includes a primary top tube 22 or beam, an adjustable saddle post 62, saddle 270 and handlebar system 32. The primary top tube 22 in this embodiment provides the structure from which a head set tube 24, the saddletube post 62, cranks 82 and a floor stand 92 all relate. It is to be expressly understood that other frame designs may be used as well to create the procumbent, weight forward experience. In this first embodiment, the top tube 22 is formed in the shape of a rectangular beam, but could be formed in a round tube as well as any other configuration that would serve the purpose of a top tube. A down tube 26 includes a double tube portion 44 extending from the top tube 24 and extending into parallel forks 46, 48 at the distal end for mounting of a resistance wheel 42. Dropouts 50, 52 are mounted into slots in the middle of the forks 46, 48. The dropouts may also be manufactured as part of the forks as well. A resistance wheel 42 and a drive train 80 (discussed in greater detail below) are mounted via the dropouts 50, 52 to the parallel forks 46, 48.

The handlebar system 30, including handlebars 32, is secured to the head set tube 24 in a conventional manner to allow for adjustable fit for various rider heights 40. The head set tube 24 is secured between the two mating adjustment plates 23. The saddle post 62 is mounted to the same mating adjustment plates 23, preferably in a manner that allows adjustment vertically, horizontally and in pitch, and these mating adjustment plates 23 are attached to the top tube 22. In the embodiments shown in FIGS. 1 and 2, the saddlepost 62 can be positioned along a horizontal axis as well as vertically axis and in a pitch axis, then securely affixed in position. In this embodiment the handlebar system 30 and the saddle post 62 are secured between the mating adjustment plates so that both can be adjusted and then secured in place between the mating adjustment plates 23 in a variety of positions. A unique sling swing system 70 FIG. 5, as described below, supports the pelvic region of a rider so that the rider can engage the unique drive train 80 mounted rearward of the exercise apparatus' sling swing 271, as discussed in greater detail below.

Saddle Embodiments

There are a variety of saddle system that can be used with this apparatus and they will be defined next and are shown in FIGS. 5-9. These Figs. Show a stationary exercise apparatus having an angled main frame, a handlebar assembly connectable to a first end of the angled main frame, a frontal-torso assembly connectable to the angled main frame and positioned behind the handlebar assembly, a rotatable crankset positioned behind the frontal-torso assembly, a pair of crankarms having pedals mounted thereon connected to opposite sides of the crankset, a rotatable wheel connectable to the rotatable crankset; wherein the crankset is positioned rearward of the handlebar assembly and the frontal-torso assembly. As above, all of these configurations could have the chain connectable between the crankset and the rotatable wheel. They can all have a similar tensioning system to prevent wheel rotation and preferably a tensioning mechanism that can gradually prevent wheel rotation. As described below, the saddle embodiments can be any of a wide variety, including a strap member, a padded rolling arm, a sling swing or any other variety of torso rest.

Figure 5:
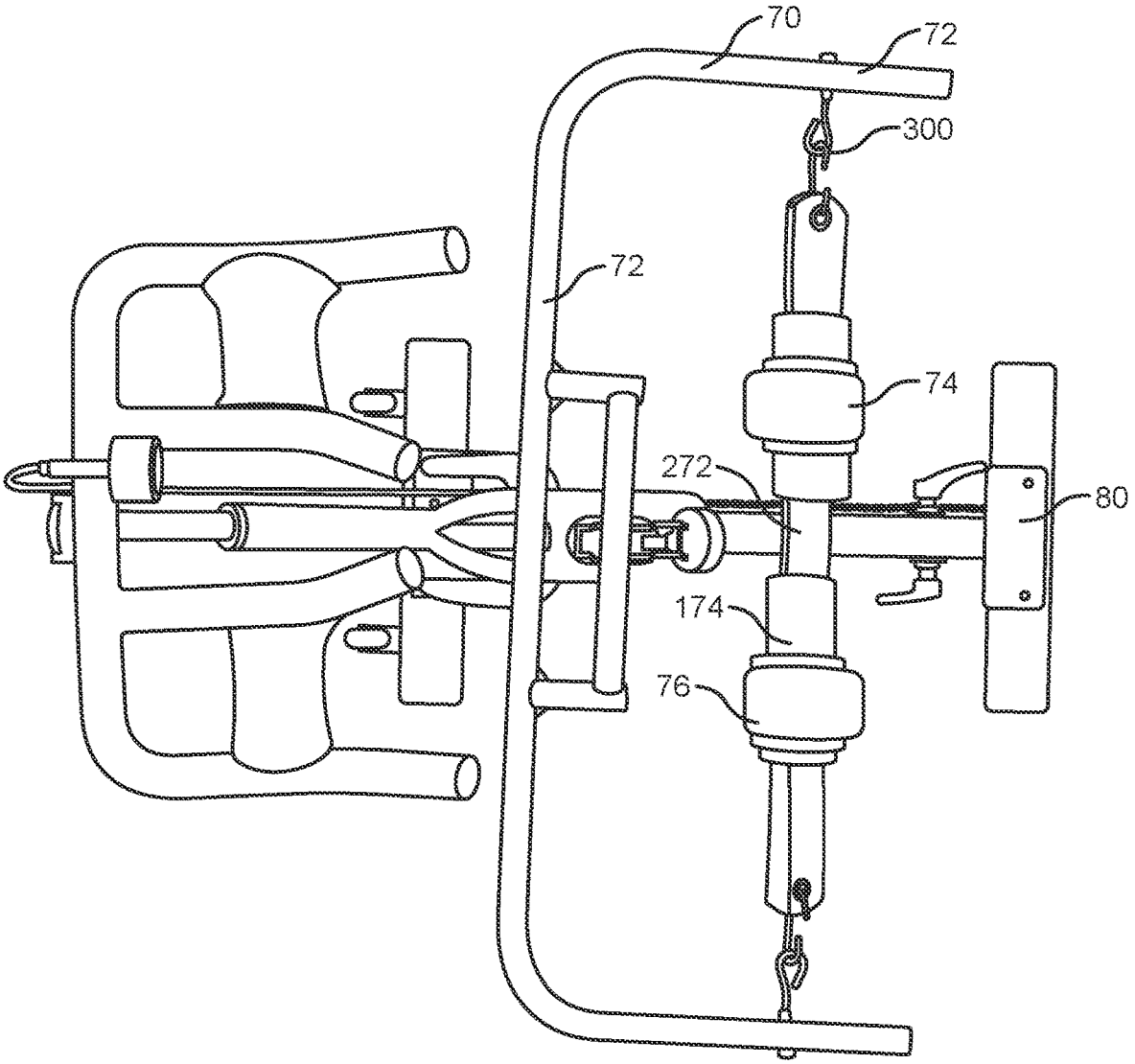
FIG. 5 is a top view of the present invention.

The saddle system 70, as shown in FIG. 5 includes a support bar 72 extending angularly along an axis transverse to the saddle post 62. A pair of spaced pads 74, 76 are mounted onto the support bar 72. The pads 74, 76 are spaced apart to support the anterior pelvic region of the rider. The pads 74, 76 can be adjusted along the support bar 72 for different riders, as well as rotated angularly for additional adjustment. The pads are adjustable so that the anterior pelvic is supported but yet there is sufficient clearance for thigh movement as the rider engages the drive train, as discussed below.

Figure 7:
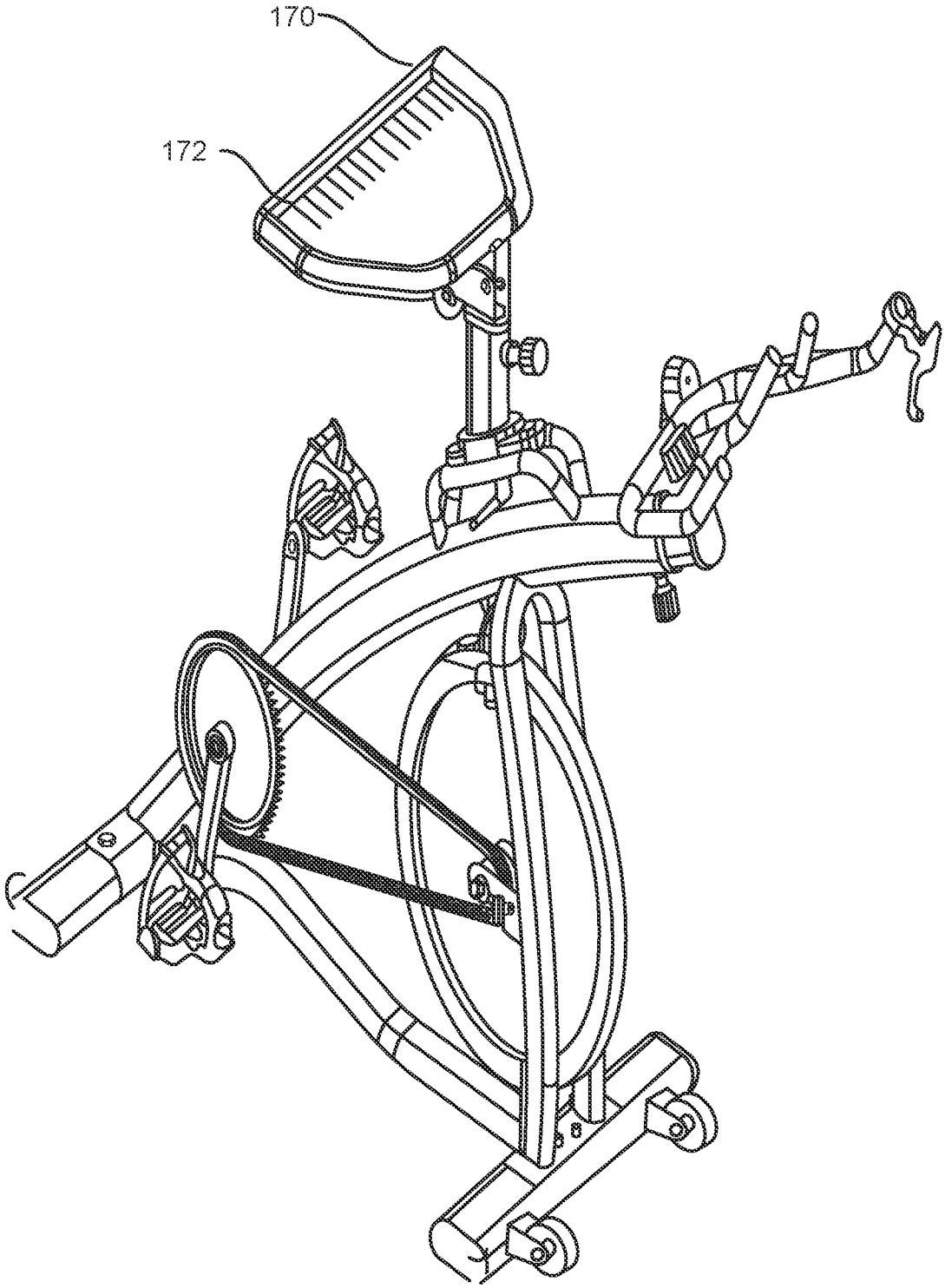
FIG. 7 is a perspective view of a second embodiment of the sling swing system.
Figure 8:
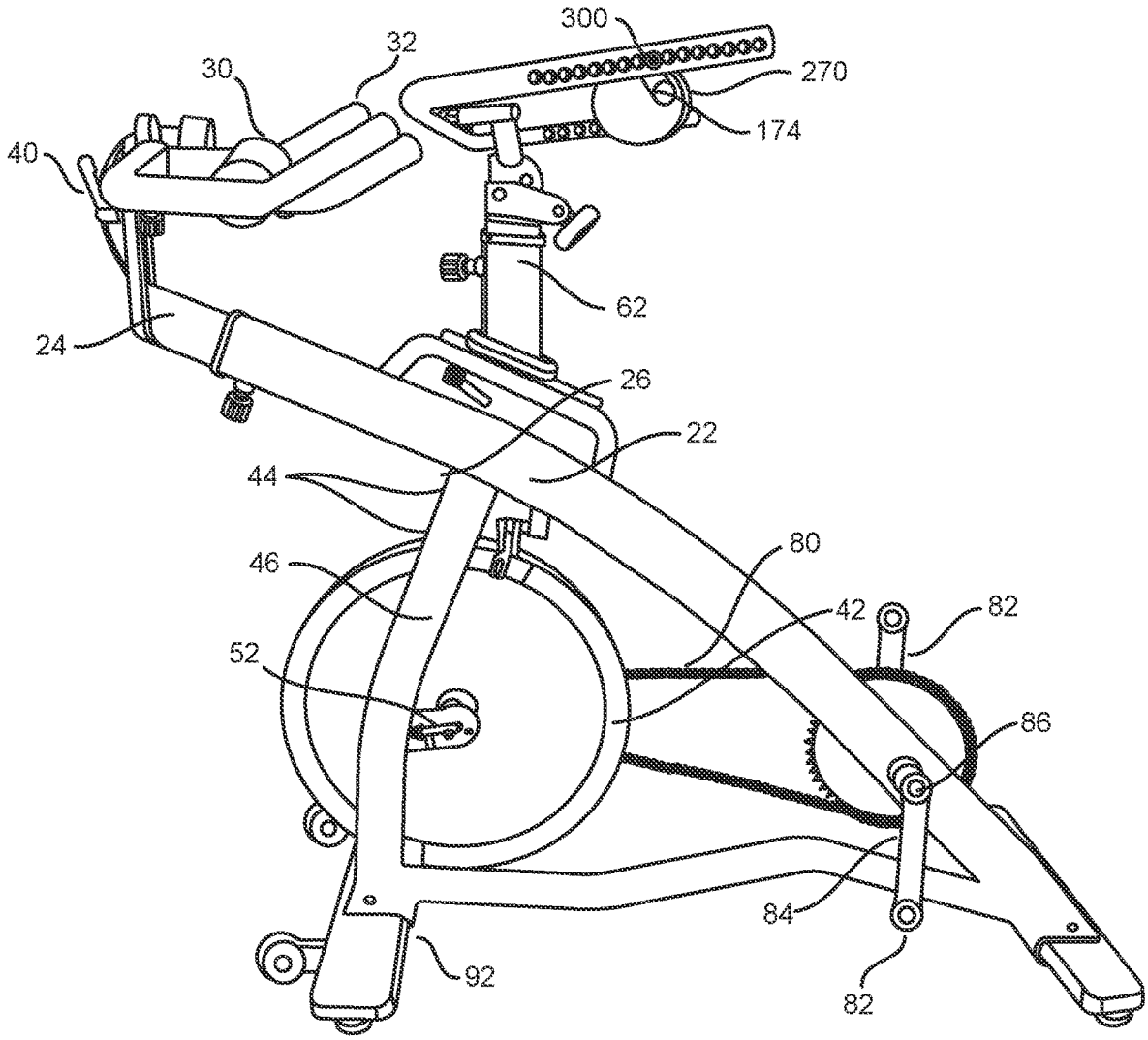
FIG. 8 is a side view of the present invention with a different sling swing system.

Another embodiment of the sling swing system is illustrated in FIG. 7. The sling swing 170 of this embodiment uses a flexible plastic material mounted directly onto the sling swing post to support the anterior pelvic region of the rider. The sling swing may also include slots 172 to provide additional flexure along with contours along the lower region to provide clearance for movement of the thighs of the rider.

Figure 6:
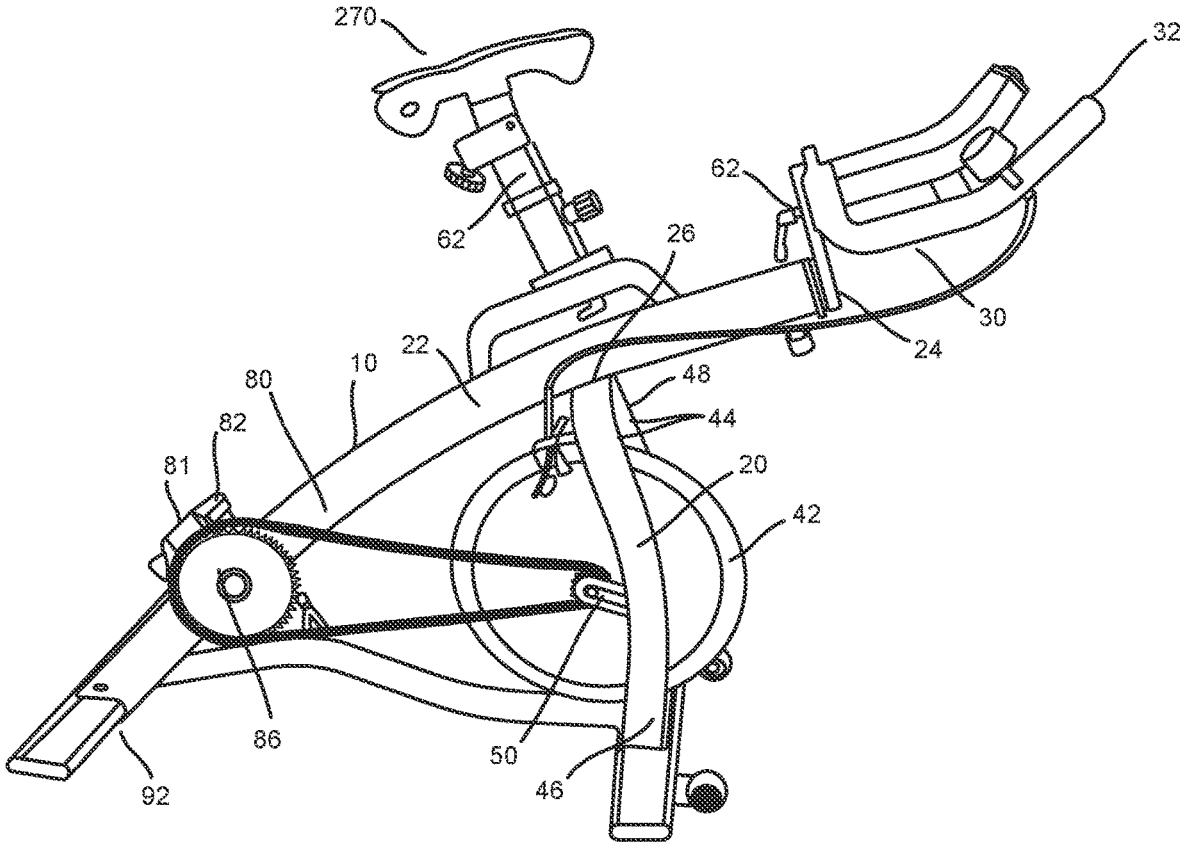
FIG. 6 is a side view of an embodiment of the present invention from the opposite side.

Another similar embodiment is illustrated in FIG. 6, 8, 9, 10. The sling swing 270 is formed of a flexible material, such as thin plastic or fabric, and may have a plurality of slots 172 formed throughout the surface. Additional padding 174 may be provided for padding and pelvic support. Other embodiments of sling swings are considered within the scope of the invention that provide support for the rider in a forward or procumbent position on the exercise apparatus.

Figure 9:
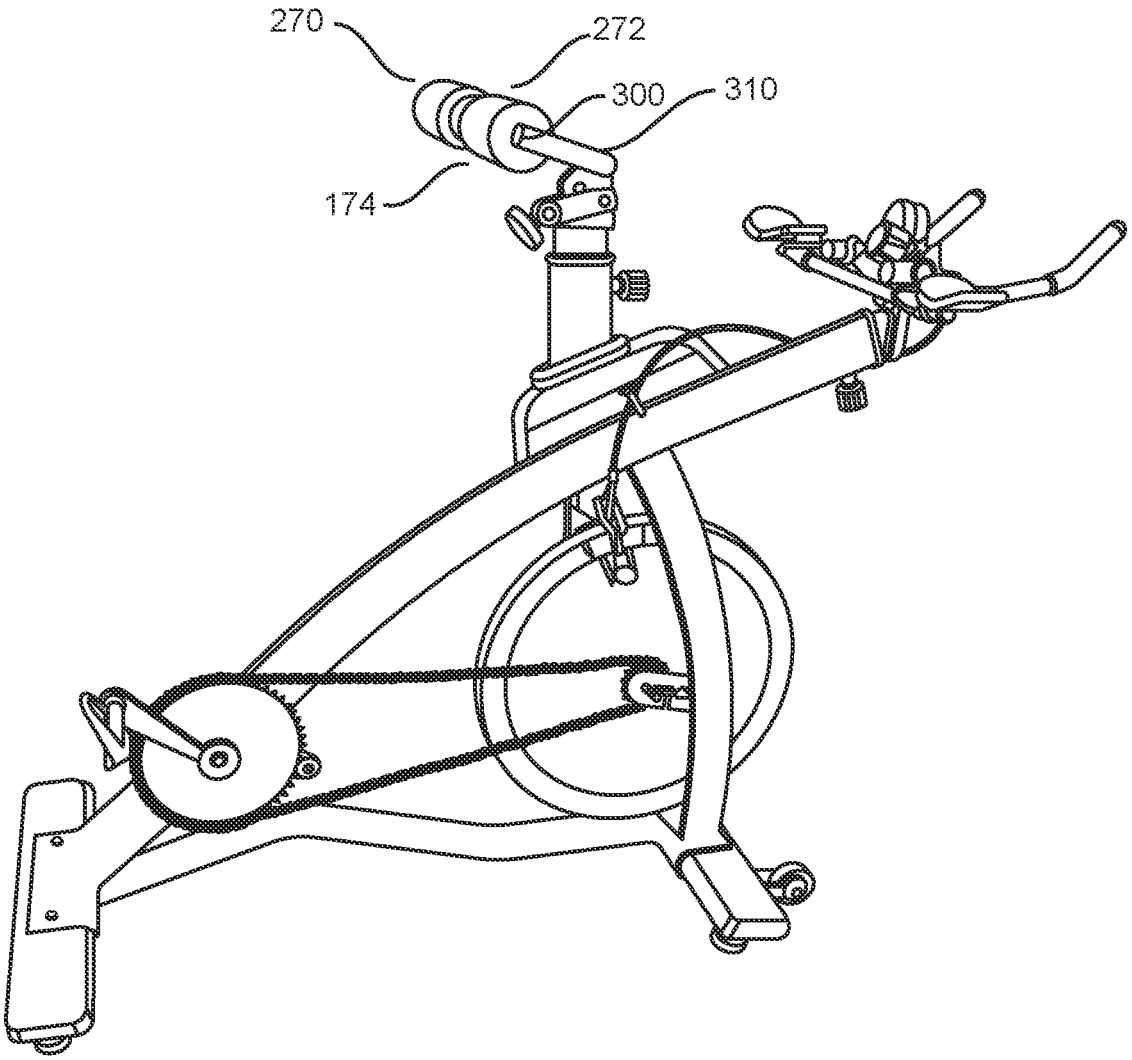
FIG. 9 is a side view of the present invention with another sling swing system.

The sling swing may also be formed of a tensioned fabric mounted on a gimbaled 300 arrangement FIG. 9. This allows the sling swing to self-position relative to the rider to provide a comfortable support for the rider. In addition, the sling swing post can be made from thin wall tubing 310 to provide a spring rate suspension instead of a fixed, rigid heavy wall post for the sling swing.

Drive Train Embodiments

The drive train system 80 is unique to the embodiments of the present invention and is illustrated in FIGS. 1, 2, 3, 4 and 6-10. The direct drive system driven by the rider's feet in a conventional manner are always located behind the sling swing, saddle or sling when using the procumbent or weight forward body position. The direct drive mechanism of this embodiment uses a freely rotatable crank spindle 86 having cranks 82, 84 and pedals 81 mounted thereto.

Other embodiments of drive trains may be used as well within the scope of the claimed inventions.

Figure 10:
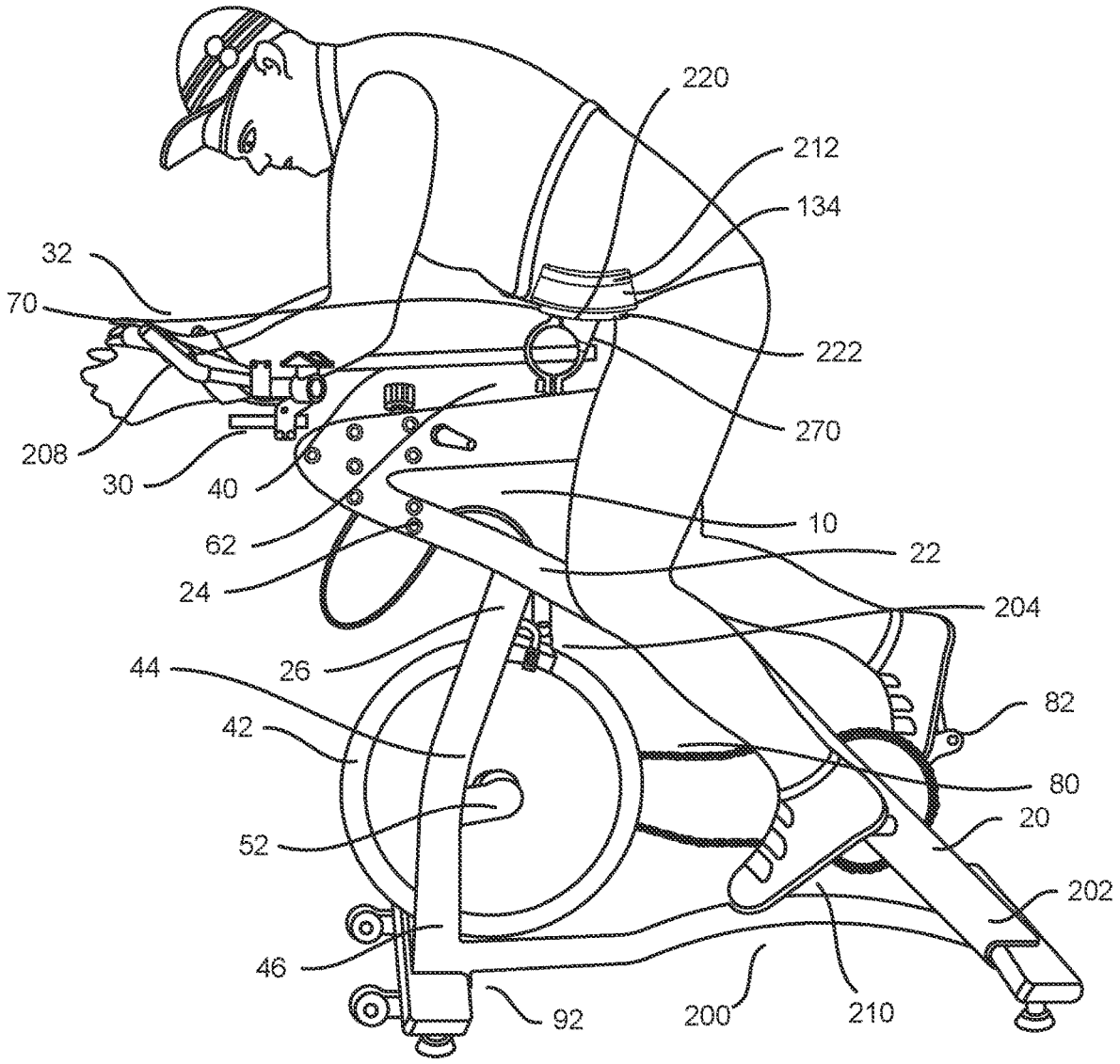
FIG. 10 is side view of the present invention with a user operating the invention.

In operation FIG. 10, the rider mounts the exercise apparatus so that the anterior pelvic region of the rider is supported by pads 134, 212 of the saddle system 70. The rider can mount his feet onto the pedals. The hands and/or arms of the rider engage the handlebar system of the exercise apparatus. The rider is thus supported in a forward leaning position on the exercise apparatus instead of the normal upright or crouched position of prior bicycles and other exercise apparatus. This provides a more natural running or sprinting position for the rider during the exercise apparatus use. The legs of the rider are at an incline and can more fully extend. Further, the power of the stroke is generated by the entire core of the rider, including the shoulders, back and abdomen, as well as the legs of the rider. This provides a much greater power stroke than in the previous style of bicycles. This also provides an all-out or 100% power making experience related to much shorter exercise time needed to maintain cardiovascular health.

In this first embodiment FIG. 10 the drive mechanism and saddle are incorporated into an exercise apparatus and this embodiment may take many different shapes and configurations. The exercise apparatus 200 of this embodiment includes the frame 202 housing an adjustable load mechanism 204. This particular embodiment, however, also includes a mounted pedal system 210 that is behind the sling swing 212 and the rider's torso with an anterior pelvic support system 220 in front of the cranks. The anterior pelvic support system 220 includes parallel spaced pads 222, 224. The user mounts the exercise apparatus 200 by placing his feet on the rear mounted pedal system 210 and supporting the front pelvic region on the saddle mount 270, and Pads 212. An adjustment mechanism (not shown) may be used to slide the pads fore and aft as well as vertically to provide a proper fit.

The use of the rear mounted pedals to transfer power from the user to the load mechanism 204 along with the anterior pelvic support enables a much fuller body workout to be achieved. Not only are the legs of the user being worked, but the trunk and core of the body of the user also achieves a workout.

An alternative embodiment not illustrated allows the front handlebar system to pivot relative to the rear mounted pedal system. This allows the user to provide additional movements during the use for his upper body.

Another embodiment of the present invention utilizes the anterior pelvic sling swing on motorized bicycles. For example, the saddle may be incorporated into a motorcycle, such as a road motorcycle or even a motocross or enduro style motorcycle. The user would be supported on rear foot pegs and on the anterior pelvic support sling swing. This provides a more streamlined and aerodynamic riding position for the rider. This position also provides more efficient support, as opposed to the upright position typical of most riders. That position can create health problems as well as discomfort over time.

Figure 3:
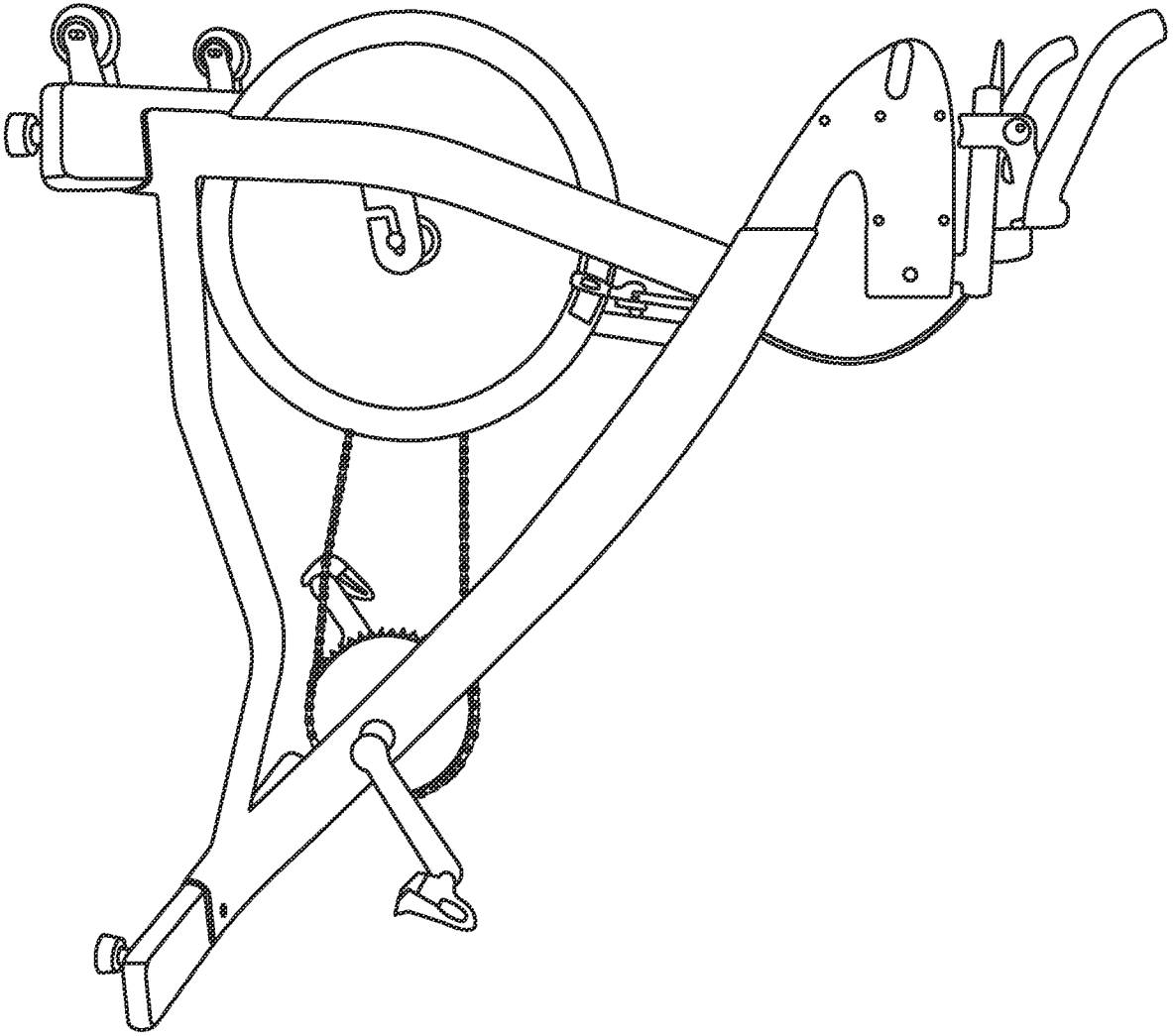
FIG. 3 is a side view of the present invention.
Figure 4:
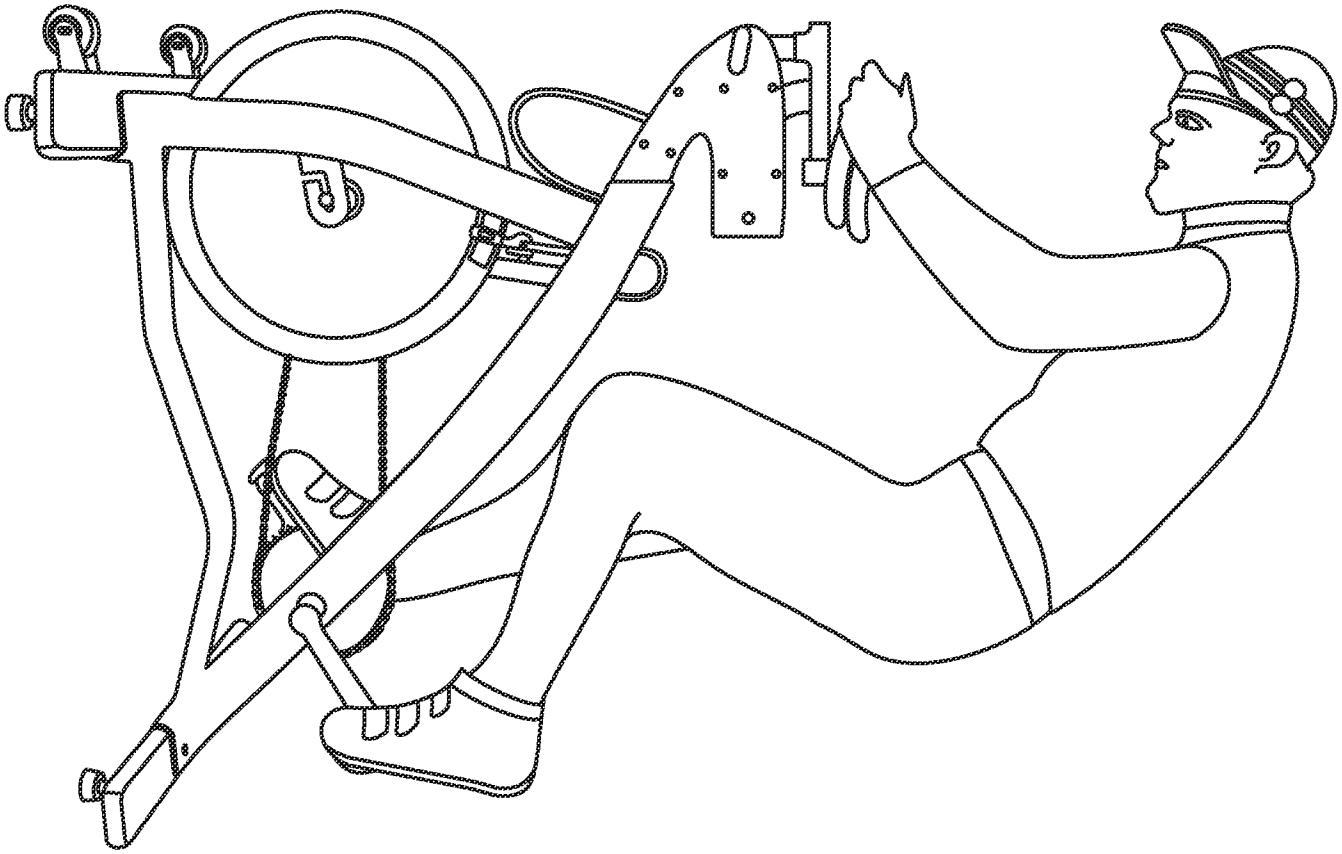
FIG. 4 is a side view of the present invention with a user operating the present invention.

No torso apparatus. FIGS. 3, 4 teach a stationary exercise apparatus having an angled main frame 10, a handlebar assembly 270 connectable to a first end of the angled main frame, rotatable pedal assembly 86 at a second end of the angled main frame having a rotatable crankset, a pair of crankarms, and a pair of pedals mounted on the crankarms, a resistance assembly connectable to the rotatable crankset and where the crankset is positioned rearward of the handlebar assembly and the frontal-torso assembly. It can be seen from the figures that this embodiment does not even have a torso rest. This version is designed to be used entirely in the upright position, thus forcing the rider to continually move. This embodiment can also have the resistance assembly be a wheel and the wheel can be connected to the rotatable crankset via a chain. The resistance mechanism can be built into the crank set internally, but might be easier to manufacture if an off the shelf wheel is used with a chain and tensioning mechanism.

The benefits of the present invention range from providing a more ergonomic body position from which to exercise at 100% of potential effort, to utilizing most if not all of the body to transfer power to the device. The frame angle can also be important. Ideally the angle is anywhere between 25 and 90 degrees but is preferably between 30 and 70 degrees from horizontal. This configuration creates the most comfortable position while still allowing the user to get the most cardio and work out benefits.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

Although the invention has been described with reference to the preferred embodiments illustrated in the attached drawing figures it is noted that equivalents may be employed and substitutions made herein without departing from the scope of the invention as recited in the claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements
so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also
including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Having thus described the various embodiments of the invention, what is claimed as new and desired to be protected by letters patent includes the following.

The invention claimed is:

1. An exercise apparatus comprising:
a stationary frame;
a handlebar assembly;
a frontal-torso support assembly;
a pair of mating adjustment plates; wherein
said frontal-torso support assembly and said handlebar assembly are secured in place by, and adjustable between said pair of said mating adjustment plates;
a resistance assembly; and
a rotatable crankset, having a pair of crankarms with pedals mounted thereon, that is positioned rearward of said handlebar assembly, said pair of mating adjustment plates, and said frontal-torso support assembly.

2. The exercise apparatus of claim 1 wherein said frontal-torso support assembly includes:
at least one pelvic support to support an anterior pelvic region of a rider.

3. The frontal-torso support assembly of the exercise apparatus of claim 2, wherein said at least one pelvic support is at least two pelvic supports that are spaced apart from one another to provide individual support to each anterior pelvic regions of said rider.

4. The exercise apparatus of claim 3 wherein said at least two pelvic supports include:
a flexible member to provide support to said anterior pelvic region of said rider.

5. The exercise apparatus of claim 1 wherein said resistance assembly comprises a wheel and a wheel tensioning mechanism.

6. The exercise apparatus of claim 5 wherein said wheel and said crankset are connected via a chain.

7. The exercise apparatus of claim 1 wherein said frontal-torso support assembly further includes a gimbaled mechanism to adjust a suspension.

8. The stationary exercise apparatus of claim 1 wherein the crankset and a tensioning mechanism operate together and internally.

9. A stationary exercise apparatus comprising:
an angled main frame; a frontal-torso support assembly;
a handlebar assembly having:
a handlebar member;
an L-shaped headset tube;
a pair of mating adjustment plates; wherein said frontal-torso support assembly and said handlebar assembly are secured in place by, and adjustable between said pair of said mating adjustment plates; wherein said handlebar assembly is horizontally adjustable on a first leg of said L-shaped head set;
a second leg of said L-shaped headset tube is secureable between said mating adjustment plates so that said headset tube is vertically adjustable along said second leg of said L-shaped headset tube;
a rotatable pedal assembly at a second end of said angled main frame, comprising:
a rotatable crankset;
a pair of crankarms; and
a pair of pedals mounted on said crankarms;
a resistance assembly connectable to said rotatable crankset; and said crankset is positioned rearward of said handlebar assembly.

10. The stationary exercise apparatus of claim 9 wherein:
said resistance assembly is a wheel; and
said wheel is connected to said rotatable crankset via a chain or belt.

11. A stationary exercise apparatus comprising:
an angled main frame;
a pair of mating adjustment plates;
a handlebar assembly;
a frontal-torso support assembly positioned behind said handlebar assembly; wherein
said handlebar assembly and said frontal-torso support assembly are both secured in place by, and adjustable between said pair of said mating adjustment plates;
a rotatable crankset positioned behind said frontal-torso support assembly;
a pair of crankarms having pedals mounted thereon connected to opposite sides of said crankset;
a rotatable wheel connectable to said rotatable crankset; wherein
said crankset is positioned rearward of said handlebar assembly and said frontal-torso support assembly.

12. The stationary exercise apparatus of claim 11 further comprising:

a chain, connectable between said crankset and said rotatable wheel.

13. The stationary exercise apparatus of claim 11 further comprising a tensioning mechanism that can gradually prevent wheel rotation.

14. The stationary exercise apparatus of claim 11 wherein said frontal-torso support assembly is a strap member, connectable between opposite side arms.

15. The stationary exercise apparatus of claim 11 wherein said frontal-torso support assembly is a padded rolling arm, connectable between opposite side arms.

16. The stationary exercise apparatus of claim 11 wherein an angle of said angled main frame is between 30 degrees and 70 degrees.

* * * * *